US010054391B1

(12) United States Patent
Lyman

(10) Patent No.: US 10,054,391 B1
(45) Date of Patent: Aug. 21, 2018

(54) HANDGUN GRIPS AND INSERT

(71) Applicant: Robert Neale Lyman, Centennial, CO (US)

(72) Inventor: Robert Neale Lyman, Centennial, CO (US)

( * ) Notice: Subject to any disclaimer, the term of this patent is extended or adjusted under 35 U.S.C. 154(b) by 661 days.

(21) Appl. No.: 14/298,960

(22) Filed: Jun. 8, 2014

Related U.S. Application Data

(60) Provisional application No. 61/833,282, filed on Jun. 10, 2013.

(51) Int. Cl.

| | |
|---|---|
| ***F41C 7/00*** | (2006.01) |
| ***F41C 3/00*** | (2006.01) |
| ***F41A 3/00*** | (2006.01) |
| ***F41A 5/00*** | (2006.01) |
| ***F41A 9/00*** | (2006.01) |
| ***F41C 23/10*** | (2006.01) |

(52) U.S. Cl.
CPC ..... *F41C 3/00* (2013.01); *F41A 3/00* (2013.01); *F41A 5/00* (2013.01); *F41A 9/00* (2013.01); *F41C 23/10* (2013.01)

(58) Field of Classification Search
CPC ..... F41C 23/10
USPC ..... 42/16, 71.01, 71.02, 72, 74; 89/1.42; D22/108; 16/421, 430
See application file for complete search history.

(56) References Cited

U.S. PATENT DOCUMENTS

| | | | | |
|---|---|---|---|---|
| 3,815,270 | A * | 6/1974 | Pachmayr | 42/71.02 |
| 4,625,445 | A * | 12/1986 | Ruger | 42/71.02 |
| 4,771,562 | A * | 9/1988 | Ruger | 42/71.02 |
| 4,999,941 | A * | 3/1991 | Farrar | 42/71.02 |
| 5,231,237 | A * | 7/1993 | Cupp | 42/71.02 |
| 5,465,520 | A * | 11/1995 | Cupp | 42/71.02 |
| 5,621,997 | A * | 4/1997 | Pearce | 42/71.02 |
| 6,073,381 | A * | 6/2000 | Farrar et al. | 42/71.02 |
| 7,018,142 | B2 * | 3/2006 | Cooper | 408/124 |
| 7,287,455 | B2 * | 10/2007 | Key-Carniak et al. | 89/36.01 |
| 8,156,677 | B2 * | 4/2012 | Glock | 42/71.02 |
| 8,584,390 | B1 * | 11/2013 | Fraher et al. | 42/71.02 |
| 2004/0079017 | A1 * | 4/2004 | Harris | 42/86 |
| 2007/0084101 | A1 * | 4/2007 | Pikielny | 42/71.01 |

* cited by examiner

*Primary Examiner* — Gabriel Klein
(74) *Attorney, Agent, or Firm* — Robert N. Lyman LLC

(57) ABSTRACT

An insert for repair or increase durability of 1911-style firearms is disclosed. In addition, a grip modification particularly suited for concealed carry is disclosed.

1 Claim, 4 Drawing Sheets

HANDGUN GRIPS AND INSERT

BACKGROUND

The popular "1911" style handgun designed by John Browning and produced by Colt under U.S. Pat. No. 984,519 has inspired countless imitators and variations on the original design, as well as creating an industry of aftermarket parts and gunsmiths employed installing them. However, deviations from the original design have not always been as reliable or durable as the original. In particular, when aluminum is used as a frame material rather than steel, damage can occur which steel frames do not suffer. Hollow-point ammunition, common in self-defense and law-enforcement applications, can dent or gouge an aluminum frame. Certain magazine followers can do the same. The impact of the barrel on the frame can, over time, result in peening, especially if high-power ammunition is used.

In addition, sometimes incompetent gunsmithing will result in damage to a pistol frame of any material, especially when the feed ramp is polished or "repaired" in an effort to improve reliability.

For some years, Evolution Gun Works has offered a steel replacement for 1911 feed ramps to repair damaged frames and improve durability. While popular and effective for its purpose, this part does not address damage caused by repeated barrel impacts to the vertical impact surface.

Another popular modification to the 1911 is changing of the panels located on either side of the grip. Existing grips vary in thickness, material, and utility, and range from custom carved ivory to molded plastic, and from cheap, smooth walnut to elaborately checkered exotic woods.

As the 1911 is a popular choice for self-defense, grips useful for concealed carry of firearms are in demand. These grips face a balancing act: aggressive checkering or other texturing is helpful when a firearm is used under stress, when sweat or blood may make it slippery, or a user's grip may be rendered suboptimal by adrenaline or the need for a quick draw and first shot. However, such textures can abrade both clothing and skin when worn close to the body, tend to snag on loose clothing when drawn, and can make it difficult for a user to slip his hand around the grip when drawing from a concealed position. In this sense, the demands of concealed carry are more stringent than those of duty carry by police officers, and call for different solutions.

Although modern polymer-framed pistols often do not have removable grip panels on the sides of their grips, they do have removable backstraps, which face similar constraints when used for concealed carry.

SUMMARY

An insert for a 1911-style firearms comprising both a feed ramp and a vertical impact surface so sized as to reproduce the the approximate dimensions of a corresponding portion of a conventional frame.

A grip for a handgun, comprising a body with a plurality of holes passing through it.

DETAILED DESCRIPTION

A 1911-style pistol may benefit from the replacement of a portion of its frame. Replacement may be required as a result of damage or sloppy gunsmithing, or it the case of frames made of materials softer or weaker than steel, it may be performed prophylactically, to increase durability and long-term reliability of the firearm.

Figure 1:
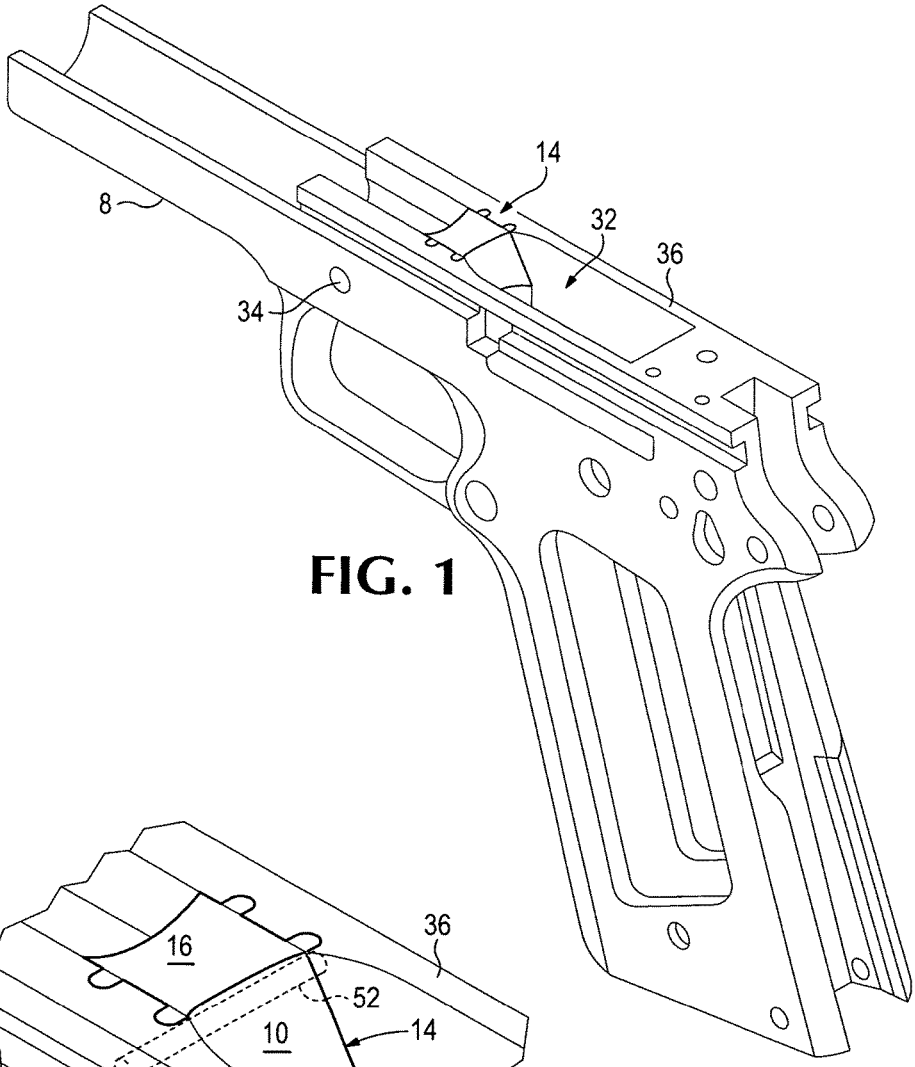
FIG. 1 is a perspective drawing of a 1911-style firearm frame with the insert highlighted with bold lines.
Figure 2:
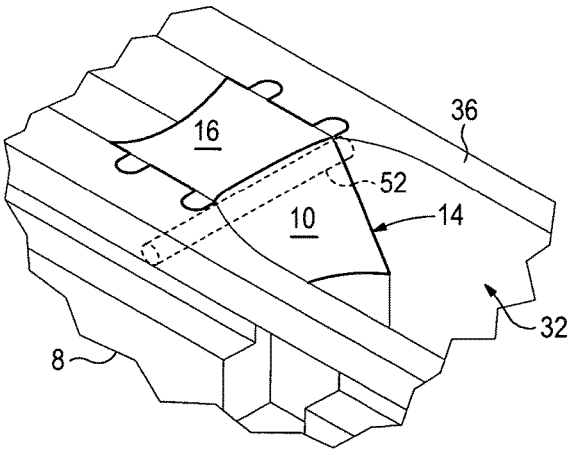
FIG. 2 is a close up of the frame showing the insert in greater detail.
Figure 3:
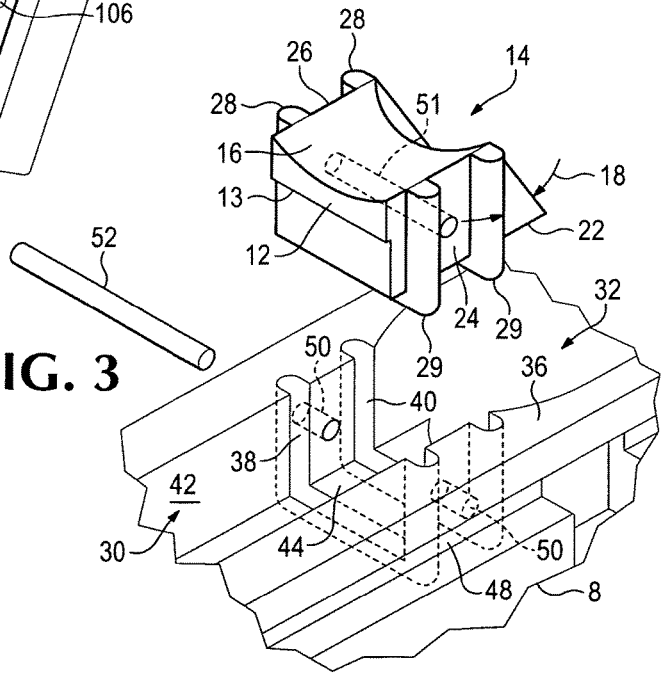
FIG. 3 is a perspective view of a 1911-style firearm frame, showing a portion of the frame removed for replacement, and the insert in position for insertion.

Referring to FIGS. 1-3, a feed ramp 10 and vertical impact surface 12 of a 1911-style handgun frame 8 may be replaced with an insert 14. The insert itself is preferably made of chrome-moly steel, such as 4140 or 4340, hardened to approximately Rockwell C 30.

The insert 14 must have external dimensions which replicate those of an unmodified frame 8 and also allow for a close interface to transfer force effectively to the frame 8 without unnecessary movement of the insert. The top of the insert 14 forms a barrel bed 16, which has a cylindrical shape with a first radius of about 0.348". The rear of the insert 14 forms a feed ramp 10 with a similar cylindrical shape, with a second radius of 0.236". The feed ramp 10 meets the barrel bed 16 with an included angle of approximately 121.5 degrees, resulting in an angle with the vertical 18 of about 31.5 degrees. The vertical impact surface 12, meanwhile, meets the barrel bed 16 with an included angle of about 90 degrees, and is substantially flat except for an optional small undercut 13 on the lower portion. These dimensions match those of the original 1911 design.

The bottom 22 and sides 24, 26 are substantially flat and meet at 90 degree angles, forming a substantially rectangular cross section. Vertical frame interface surfaces 28, protrude approximately 1/16" from the sides 24, 26 and are approximately 1/16" wide, with a 1/32" radius as shown in FIG. 3. The horizontal frame interface surfaces 29 are similarly shaped and protrude from the bottom 22 of the insert 14.

Installation of the insert 14 begins with cutting the frame 8 to accept it. The corresponding portion of the frame is removed using a milling machine to extend the barrel lug slot 30 all the way to the magazine well 32. This slot is approximately 0.365" wide, and is cut to a depth of approximately 0.135" above the center of the slide stop pin hole 34, or about 0.315" below the top of the slide rails 36. These dimensions may require adjustment by a few thousandths of an inch either way to account for manufacturing variations in both the frame 8 and the insert 14. Careful measurements should be made before any cutting is attempted.

When the slot 30 has been extended, recesses 38, 40 must be cut to receive the frame interface surfaces 28, 29. A 1/16" ball end mill is used to cut vertical recesses 1/16" deep in the sides 42 of the slot 30, and horizontal recesses 1/16" deep in the bottom 44 of the slot 30. A ball end mill is preferred because a rounded cross-section of the recesses 38, 40 is less likely to develop stress cracks than a square cross-section. In a preferred embodiment, the first recess 38 is cut with its center approximately 0.525" from the center of the slide stop pin hole 34, or about 3/32" from the original location of the vertical impact surface. The second recess 40 is then cut with its center approximately 0.730" from the center of the slide stop pin hole 34, or 0.205" behind the center of the first recess 38. Again, these dimensions will require confirmation before cutting to account for manufacturing tolerances.

The insert 14 is placed in the frame 8 and the fit is verified. It is advisable, when manufacturing an insert 14, to deliberately make it somewhat larger than is strictly necessary to allow for dimensional variation in the frame cuts. Small adjustments to the size of the insert 14 and the frame interface surfaces 28, 29 on critical dimensions may be made with files or with a mill or surface grinder. Blueprints showing all the critical dimensions of a 1911-style pistol are widely available to assist this fitting step. In a preferred embodiment, there is a small degree of interference between the insert 14 and the frame 8, such that the insert requires some force to put in place.

When the fit is satisfactory, the insert must be permanently attached to the frame. If the frame 8 and insert 14 are made of compatible materials, it may be welded. However, welding will affect the heat treatment of both the frame 8 and the insert 14, and may require that the resultant assembly be stress-relieved or heat treated anew. If the frame 8 is made of a different material than the insert 14, as is the case for aluminum frames, then it is preferable to attach the insert 14 by the use of a pin 52. The insert 14 should be clamped firmly against the frame such that all insert surfaces are in solid contact with the corresponding surfaces on the frame. Then a hole may be drilled through both the frame (50) and the insert (51). Preferably, this hole 50, 51 is 1/16" in diameter and is drilled through the slideway 48, similar to the hole used to retain the ejector in place. Preferably, the hole 50, 51 is located about halfway between the first recess 38 and the second recess 40. A pin 52 may then be inserted to retain the insert 14 in place. Preferably, this pin 52 is a roll pin, although a solid pin may also be chosen. A screw or screws might also be used. A hole 50, 51 may be drilled in other locations, such as lower on the frame 8, where it the frame 8 is thicker, but care must be taken that the hole 50 does not damage the serial number or manufacturer name and location, as both of these are required by law to be displayed. Regardless of the securement method, the insert 14 must be fit closely to the frame and so that the roll pin or other securement device is not bearing the bulk of forces when the gun is fired.

Preferably, some form of sealant is used to between the insert 14 and the frame 8 to bond the two and limit the entry of corrosive gases and moisture. Choices include wicking threadlocker such as LOCTITE® 290, made by the Permatex Corporation, or bearing/sleeve mounting compounds such as LOCTITE® 609.

A gun grip intended for concealed carry must meet two contradictory requirements. It must allow for a reliable, firm grip on the gun even when used under great stress, and it must be comfortable to wear and easy to draw from a concealed position. Therefore, it must not be either too smooth or too textured.

Figure 4:
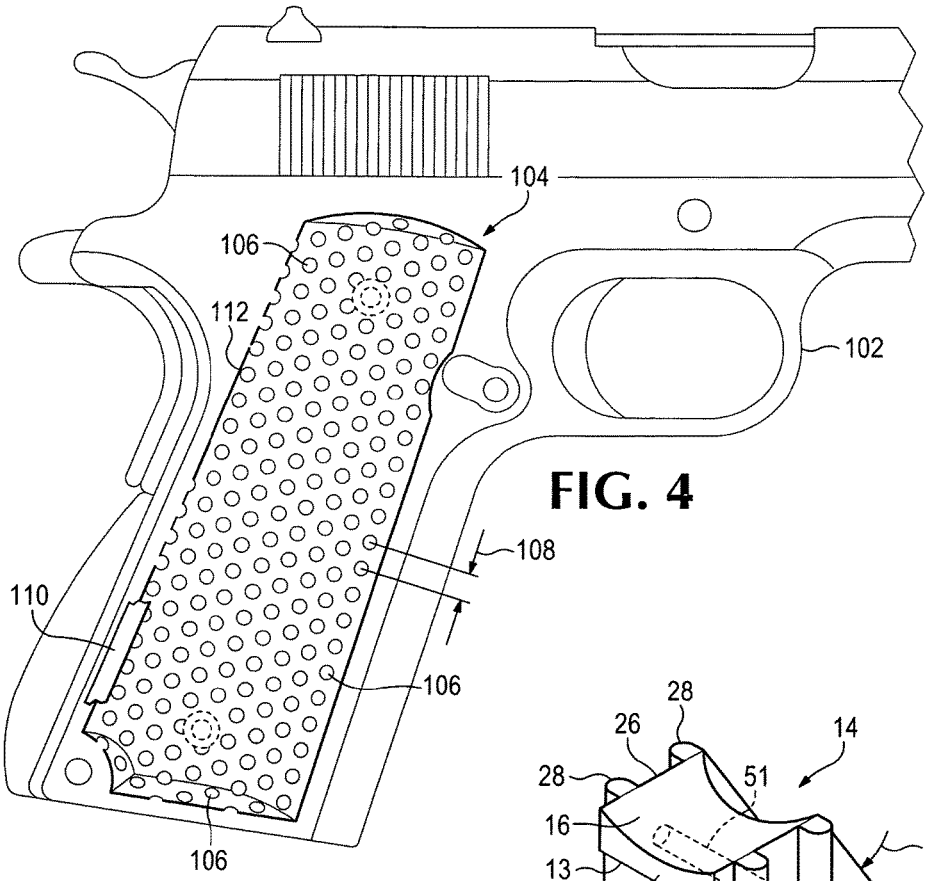
FIG. 4 is a plan view of one embodiment of a novel grip mounted on a 1911-style handgun.

FIG. 4 shows one solution to this problem. A 1911-style handgun 102 is mounted with a pair of grips comprising bodies 104 formed from perforated sheet metal. The surface of the metal is relatively smooth. The exact finish is not important; bead blasting or mirror polishing are both acceptable, as are coatings such as powder coating or paint, as well as surface treatments such as bluing, phosphate treatment (such as PARKERIZING®), or nitrocarburizing (such as MELONITE®). The smoothness makes the grip body 104 comfortable against the skin when worn for extended periods. It also prevents grabbing of clothing, which can be at best embarrassing, revealing a handgun 102 that a wearer would prefer stay hidden, or at worst dangerous, as it interferes with a rapid presentation of the weapon in a life-threatening situation. Finally, a relatively smooth grip body 104 is comfortable for a user's hand to remove from concealment. Typically concealed-carry holsters place a handgun 102 very close to a user's body, and sometimes even inside of a user's pants. This requires that the user's fingers slide between the handgun 102 and a beltline or the user's torso. The smooth surface of the grip body 104 makes this sliding both fast and comfortable.

The entire body 104 is perforated with holes 106. The holes allow the skin of a user's hand to enter the grip body 104 slightly, and thereby provide positive control over the handgun 102 under recoil. When ungripped, or gripped lightly, the gun 102 has a smooth character, but when gripped firmly, it takes on a textured character. This provides the balance required.

In a preferred embodiment, the holes 106 are round, 3/32" in diameter, and located in a hexagonal, or 60 degree staggered, pattern with a 5/32" distance 108 between their centers. This combination is aesthetically pleasing, especially when the hole pattern is aligned with the front edge of the grip body 104, as best shown in FIG. 4. However, no particular pattern is required for the functional purposes described above. Many varieties of perforated metal are available and may be chosen to suit a user's preferences. When the preferred hole pattern is used, 20 gauge 304 stainless steel is preferred as a material. This combination provides adequate stiffness even when strongly gripped by a user, but is still relatively lightweight and inexpensive to both cut and form to shape.

It should be noted that perforated metal typically has a smooth side and a rough side. The rough side should be oriented inward, away from the user's hand, for maximum benefit. However, for a user seeking maximum grip and unconcerned about the possibility of snagging, the rough side may be oriented outward.

The exact dimensions of grips for a 1911-style handgun are well known from blueprints produced for the U.S. Army.

Optionally, a rubber border 110 may be placed around the body 104 before installation. This border serves to protect the finish of the handgun 102 from abrasion by the steel edge 112. U-shaped rubber is available commercially.

Figure 6:
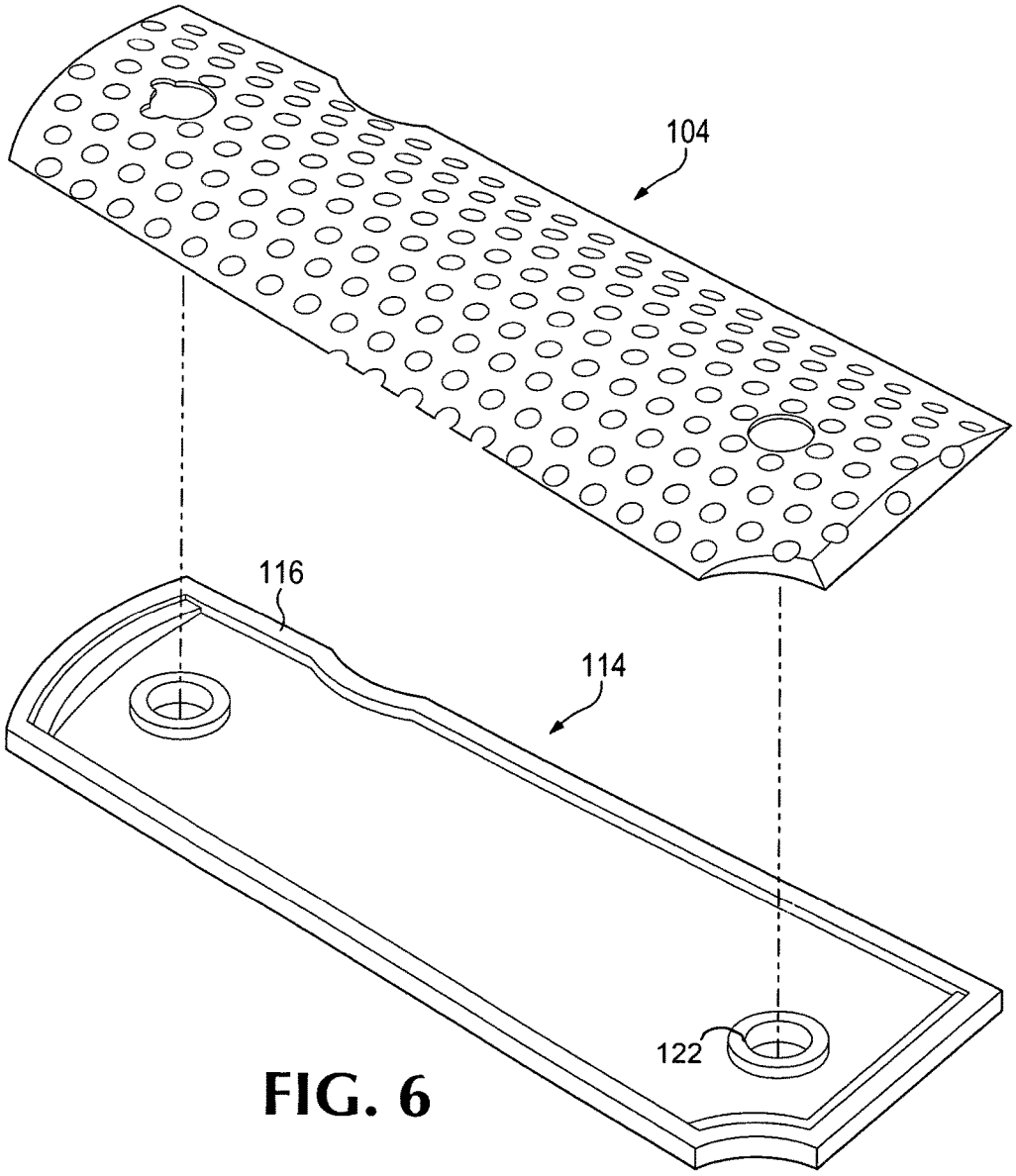
FIG. 6 is a perspective view of one embodiment of a grip for a 1911, showing a protective panel for mounting between the grip and the gun.

In one embodiment, best shown in FIG. 6, a protective panel 114 is placed beneath the grip body 104. This panel may have a raised outline 116 that touches the edge 112, thus preventing any sharp portions of said edge 112 from coming into contact with the firearm 102, a user, or a user's clothing. The protective panel 114 also prevents the entry of any foreign substance such as dirt or water into the handgun 102 through the holes 106. The protective panel 114 may be made of any material that does not mar the handgun 102. In an exemplary embodiment, the protective panel 114 is made of a flexible material such as urethane rubber. Because screws (not shown) are used to attach grips to a 1911-style handgun, the protective panel 114 must have holes 122 to allow the screws to pass through it.

Figure 5:
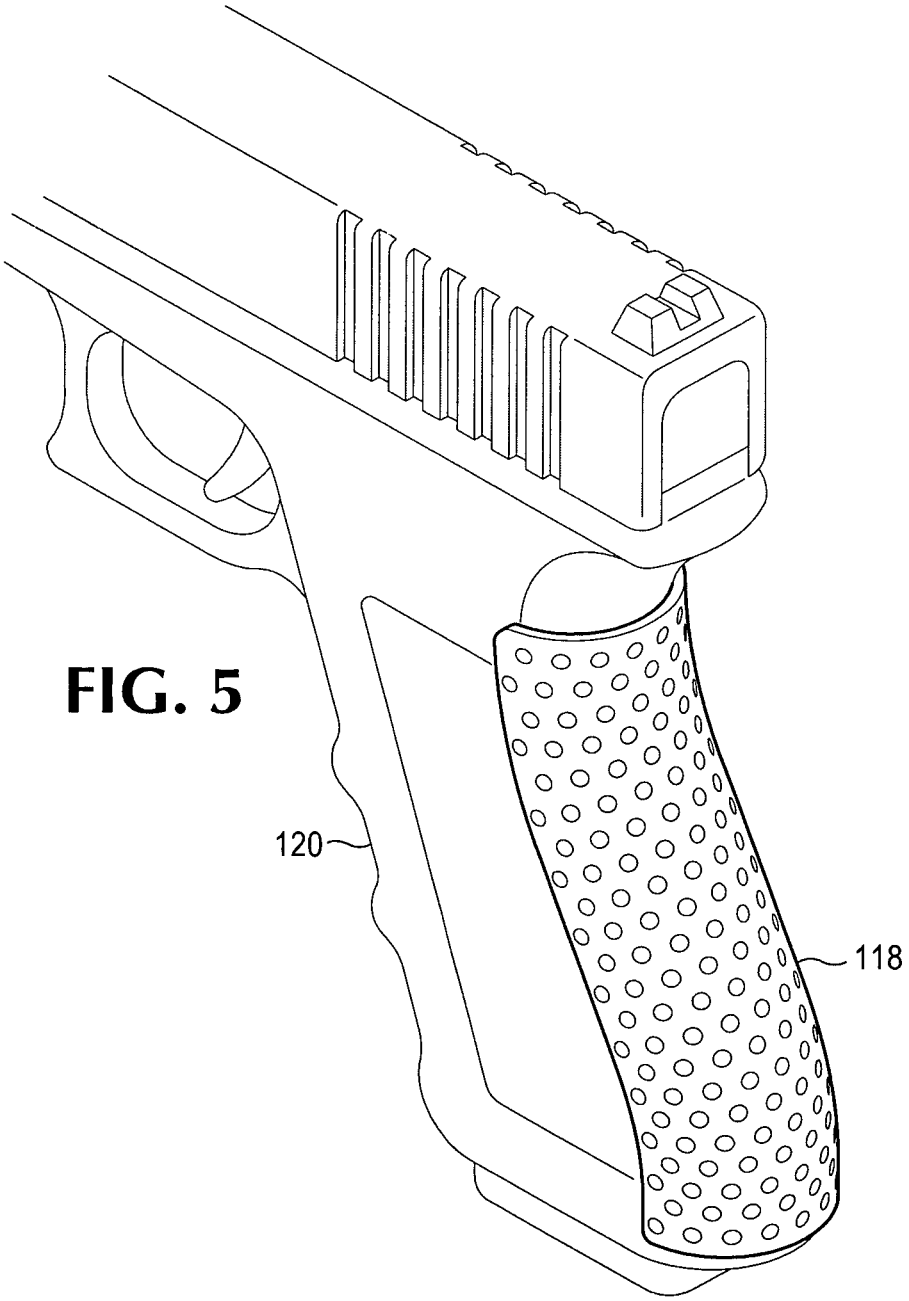
FIG. 5 is a perspective view of a GLOCK®-style handgun showing an alternative embodiment of a perforated grip on the backstrap.

FIG. 5. shows an alternative embodiment of the perforated stainless steel grip body 118, mounted on the backstrap of a GLOCK®-style handgun 120. While many polymer-framed automatic pistols do not not have removable side panels, a popular feature is the removable backstrap, which permits the adjustment of grip size to suit a user's hand. The polymer backstraps provided by manufacturers can be replaced with formed perforated stainless steel backstraps 118 in much the same way as for 1911 grips.

The invention claimed is:

1. A removable grip for a handgun, comprising a body with at least 6 holes passing through it, said holes permitting skin from the users hand to enter when said grip is squeezed, wherein the holes are laid out in a hexagonal pattern and are approximately 3/32 inches in diameter and have centers separated by approximately 5/32 inches.

* * * * *